US012221144B2

(12) United States Patent
Rodrigues et al.

(10) Patent No.: US 12,221,144 B2
(45) Date of Patent: Feb. 11, 2025

(54) RAILROAD SWITCH DEVICE FOR MOVING RAILROAD SWITCH POINTS

(71) Applicant: Mona Beaman, Thornton, TX (US)

(72) Inventors: Dilson Dos Santos Rodrigues, Hewitt, TX (US); Donald Coy Beaman, Kosse, TX (US)

( * ) Notice: Subject to any disclaimer, the term of this patent is extended or adjusted under 35 U.S.C. 154(b) by 775 days.

(21) Appl. No.: 17/493,065

(22) Filed: Oct. 4, 2021

(65) Prior Publication Data

US 2022/0105970 A1 Apr. 7, 2022

Related U.S. Application Data

(63) Continuation-in-part of application No. 17/063,717, filed on Oct. 5, 2020, now Pat. No. 12,104,331.

(51) Int. Cl.
*B61L 5/04* (2006.01)
*B61L 5/10* (2006.01)
*B61L 13/00* (2006.01)

(52) U.S. Cl.
CPC ..... *B61L 5/045* (2013.01); *B61L 5/04* (2013.01); *B61L 5/10* (2013.01); *B61L 13/00* (2013.01)

(58) Field of Classification Search
CPC .... B61L 5/02; B61L 5/04; B61L 5/045; B61L 5/10; B61L 5/102; B61L 13/00; E01B 7/00
See application file for complete search history.

(56) References Cited

U.S. PATENT DOCUMENTS

| | | | | | |
|---|---|---|---|---|---|
| 2,168,790 | A * | 8/1939 | Bone | B61L 5/02 | 246/291 |
| 5,375,796 | A * | 12/1994 | Turner | B61L 5/04 | 246/393 |
| 5,531,408 | A * | 7/1996 | Wechselberger | B61L 5/02 | 246/291 |
| 5,772,157 | A * | 6/1998 | Lauck | B61L 5/04 | 246/258 |
| 6,032,906 | A * | 3/2000 | Potter | B61L 5/06 | 246/257 |
| 6,286,791 | B1 * | 9/2001 | Young | E01B 7/02 | 246/389 |
| 9,156,479 | B2 * | 10/2015 | Beamon | B61L 5/107 | |
| 11,780,478 | B1 * | 10/2023 | Rodrigues | E01B 7/00 | 246/415 R |

(Continued)

*Primary Examiner* — Zachary L Kuhfuss
*Assistant Examiner* — Cheng Lin

(57) ABSTRACT

Disclosed is a railroad switch device for moving railroad switch points. The device includes two spring assembly sets placed over two switch operation rods. The spring assembly sets move railroad switch points and keep railroad switch points against a stock rail. At least one sensor is mounted adjacent to two switch operation rods. The switch operation rods have a switch point position target connected to the switch operation rods. The switch point position target follows a movement of two throw rods. The two spring assembly sets provide a spring holding force to the two switch operation rods. The spring holding force provides a safe operation of a switch point position assembly by at least one of determining that the spring holding force is present in the moving railroad switch point, and pushing the spring holding force towards the switch point position assembly away from the at least one sensor.

13 Claims, 22 Drawing Sheets

(56) References Cited

U.S. PATENT DOCUMENTS

| | | | | |
|---|---|---|---|---|
| 2011/0049308 | A1* | 3/2011 | Beaman | B61L 5/04<br>246/258 |
| 2011/0133039 | A1* | 6/2011 | Beaman | B61L 5/10<br>246/448 |
| 2011/0155864 | A1* | 6/2011 | Wolf | B61L 5/02<br>246/393 |

* cited by examiner

RAILROAD SWITCH DEVICE FOR MOVING RAILROAD SWITCH POINTS

CLAIM OF PRIORITY

This application is a Continuation in Part of, is related to and claims priority from U.S. patent application Ser. No. 17/063,717 filed on May 5, 2020 to common inventor Dilson dos Santos Rodrigues and entitled SABOTAGE-RESISTANT SWITCH DEVICE FOR MOVING RAILROAD SWITCH POINTS, which is a Continuation in Part of claims priority from U.S. patent application Ser. No. 15/499,890 filed on Apr. 28, 2017 to common inventor Dilson dos Santos Rodrigues and entitled ELECTRIC-HYDRAULIC RAILWAY SWITCH DEVICE FOR MOVING RAILROAD SWITCH POINTS, which claims priority to now abandoned U.S. patent application Ser. No. 15/262,908 filed on Sep. 12, 2016, by common inventor Dilson dos Santos Rodrigues, entitled RAILWAY SWITCH DEVICE FOR MOVING RAILROAD SWITCH POINTS.

TECHNICAL FIELD

The present invention generally relates to a railroad infrastructure, and more particularly relates to railroad switch devices.

BACKGROUND

Railway track switches are mechanical devices that can change a train's course from one track to another. A typical rail track junction comprises two or more tracks that merge together or form a crossover to lead a train from one track to another. A track junction usually has a straight track and a diverging track. Because tracks diverge toward a left hand side or a right hand side of the straight track, the tracks are named either a left diverging track or a right diverging track.

The rail tracks that form a junction have three types of rails that form the whole junction. The first is a stock rail, which is a permanent rail that does not undergo any movement and extends from the junction to the length of the track. The second type of rail is an intermediary rail, known as closure rail, which is stationary in nature and does not undergo any movement when the train's course is switched. The third is a switch rail (discussed below).

The closure rails form the overlap between two different train tracks. In a track junction comprising a straight track and a right diverging track, the closure rail of the straight track passes into the path of the right diverging track and the closure rail of the right diverging track passes into the path of the straight track. Thus, the two tracks merge to form a common track. The actual track switching is achieved with the third track, the switch rail, which is movable. The switch rail terminates to form a tapering end and the ends can merge with one of the straight and the diverging tracks when they are moved laterally.

The switch rails are moved using a track switching machine. The machine is usually mechanically, hydraulically or pneumatically operated.

The machine has a switch rod that leads to the movable switch rails. When the tracks have to be aligned between the straight track and the diverging track, the switch rod is reciprocated in a lateral direction to attain a lateral shift of the switch rails. The lateral shift of the switch rails creates a shift between the two tracks.

Originally, track switch machines were operated by an operator manually every time when trains had to change their course between two different tracks. Over time track switching machines evolved to incorporate electric power systems that are remotely controlled by the operator, where the tracks are switched without the presence of the operator at the site.

Numerous switches use one or two springs to allow the train to run through a rail track junction without damaging it or the switch components. However, the realities of the threats to today's logistic infrastructure demand that infrastructure providers consider more than just the operation of the rail switch junction.

Today, we must also be concerned with terrorism and vandalism. If a terrorist wants to create havoc with the Nation's rail network, all they need to do is go to a rail track junction's mainline control point, cut the throw rod and the lock rod, and leave the point detector rod alone. This removes all holding force for the switch machine but the point will stay "in correspondence".

"In correspondence" means in this context that the current systems and devices that detect a switch's positions are detecting that each respective rod is in the correct position (because the components of the point detector rod in the switch machine are in the "correct" position), while the reality outside the switch machine is that the throw rod and lock rod could be literally anywhere in the rail track junction.

This provides the operator with an indication that it is safe to proceed. However, when the next mainline facing point move takes place over the switch, the signal will be green (indicating a safe/correct position). However, without a spring holding force to keep it secured, the switch rail will not stay next to the proper stationary rail and the derailment that occurs will likely be at a high speed.

In view of the foregoing, there is need for a railroad switch device to that reliably detects a switch point position.

Further limitations and disadvantages of conventional and traditional approaches will become apparent to one of skill in the art through comparison of described systems with some aspects of the present disclosure, as set forth in the remainder of the present application and with reference to the drawings.

DISCUSSION OF RELATED ART

State-of-the-art track switching machines are operated electrically, hydraulically or pneumatically. The machines are usually controlled by an operator who sits at a control room located at a remote location from the tracks. The machines also have a manual operation lever that can be actuated for manual shift of the tracks in case of an electric circuit failure.

US2011049308A1 of Beaman et al. is related to a hydraulically operated track switching machine. Beaman et al. consists of a switch connector rod connected to switch rails of a railway track and the movement of the switch rails is effected by the reciprocating movement of the switch connector rod. The device also has a target that signals the current status of the tracks. According to Beaman et al., the switch rails are urged to the stock rails by the spring force produced from the springs present in the track switching machine.

U.S. Pat. No. 9,156,479 also to Beaman provides a lock spring assembly mounted to a support block and coupled to a hydraulically actuated spur gear. When its hydraulic power unit is off, there is no hydraulic pressure and the lock spring provides all of the holding force to the switch points through a switch connector rod. Proximity sensors are mounted to a sensor mounting bracket, an offset target plate is coupled to a target drive rod. If the switch connector rod is cut, however, the machine will be detected to be in correspondence, and thus a train passing through the rail track junction will cause the switch rail to separate and migrate from the proper stationary rail, thus causing a derailment.

Various embodiments of the present invention target the abovementioned requirements and others related thereto.

SUMMARY OF THE INVENTION

Provided are railroad switch devices for moving railroad switch points. A preferred device includes two spring assembly sets placed over two switch operation rods. The switch operation rods move railroad switch points and the spring assembly sets keep railroad switch points against a stock rail. The switch operation rods have a switch point position target mounted on the spring assembly sets. The switch point position targets follow the movement of two throw rods. The two spring assembly sets provide a spring holding force to the two switch operation rods at the end-points of their movement. The spring holding force provides for safe operation of a switch point position assembly. The position of the switch may be determined by detecting that the spring holding force is present.

The railroad switch device includes a trailable switching unit that may be controlled through at least one of a local PLC and a remote PLC. A center stroke unit blocks a hydraulic cylinder movement at middle stroke during installation and maintenance. A mechanical target automatically monitors the spring holding force and indicates the position of a point rod, wherein the hydraulic unit is directly connected to the point rod without intermediate components.

Two spring assembly sets placed over the two switch operation rods. The spring assembly sets move the railroad switch points and keep the railroad switch points against the stock rail. At least one sensor is mounted adjacent to said two switch operation rods. The spring assembly set have a switch point position target mounted on the switch operation rods, wherein the switch point position target follows a movement of said two switch operation rods. The two spring assembly sets provide a spring holding force to the two switch operation rods, wherein said spring holding force provides a safe operation of a switch point position assembly. By determining that the spring holding force is present in the moving railroad switch point, the switch machine circuitry determines the position of the switch rods, and thus knows the position of the rail track switch.

These features and advantages of the present disclosure may be appreciated by reviewing the following description of the present disclosure, along with the accompanying figures wherein like reference numerals refer to like parts.

BRIEF DESCRIPTION OF DRAWINGS

The accompanying drawings illustrate the embodiments of systems, methods, and other aspects of the disclosure. A person with ordinary skills in the art will appreciate that the illustrated element boundaries (e.g., boxes, groups of boxes, or other shapes) in the figures represent an example of the boundaries. In some examples, one element may be designed as multiple elements, or multiple elements may be designed as one element. In some examples, an element shown as an internal component of one element may be implemented as an external component in another, and vice versa. Furthermore, the elements may not be drawn to scale.

Various embodiments will hereinafter be described in accordance with the appended drawings, which are provided to illustrate, not limit, the scope, wherein similar designations denote similar elements, and in which.

DESCRIPTION OF AN EXEMPLARY PREFERRED EMBODIMENT

Interpretation Considerations

Figure 1:
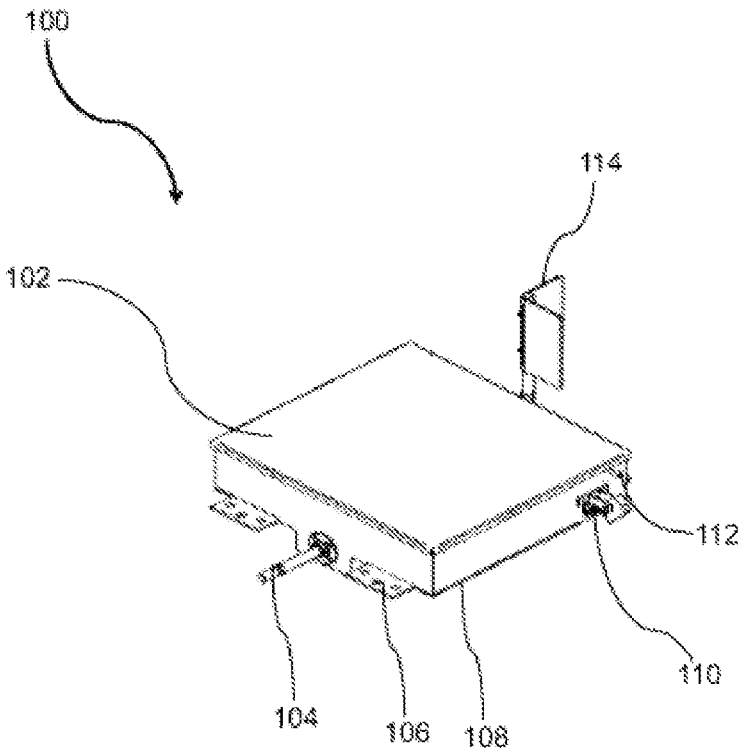
FIG. 1 illustrates a first general view of a trailable switching unit.

While reading this section (Description of An Exemplary Preferred Embodiment, which describes the exemplary embodiment of the best mode of the invention, hereinafter referred to as "exemplary embodiment"), one should consider the exemplary embodiment as the best mode for practicing the invention during filing of the patent in accordance with the inventor's belief. As a person with ordinary skills in the art may recognize substantially equivalent structures or substantially equivalent acts to achieve the same results in the same manner, or in a dissimilar manner, the exemplary embodiment should not be interpreted as limiting the invention to one embodiment.

The discussion of a species (or a specific item) invokes the genus (the class of items) to which the species belongs as well as related species in this genus. Similarly, the recitation of a genus invokes the species known in the art. Furthermore, as technology develops, numerous additional alternatives to achieve an aspect of the invention may arise. Such advances are incorporated within their respective genus and should be recognized as being functionally equivalent or structurally equivalent to the aspect shown or described.

A function or an act should be interpreted as incorporating all modes of performing the function or act, unless otherwise explicitly stated.

The present disclosure is best understood with reference to the detailed figures and description set forth herein. Various embodiments have been discussed with reference to the figures. However, those skilled in the art will readily appreciate that the detailed descriptions provided herein with respect to the figures are merely for explanatory purposes, as the methods and systems may extend beyond the described embodiments. For instance, the teachings presented and the needs of a particular application may yield multiple alternative and suitable approaches to implement the functionality of any detail described herein. Therefore, any approach may extend beyond certain implementation choices in the following embodiments.

References to "one embodiment", "at least one embodiment", "an embodiment", "one example", "an example", "for example", and so on indicate that the embodiment(s) or example(s) may include a particular feature, structure, characteristic, property, element, or limitation, but not every embodiment or example necessarily includes that particular feature, structure, characteristic, property, element, or limitation. Furthermore, repeated use of the phrase "in an embodiment" does not necessarily refer to the same embodiment.

Unless defined otherwise, all technical and scientific terms used herein have the same meaning as commonly understood by one of the ordinary skills in the art to which this invention belongs. Although any method and material similar or equivalent to those described herein can also be used in the practice or testing of the present invention, the preferred methods and materials have been described. All publications, patents, and patent applications mentioned herein are incorporated in their entirety.

It is noted that, as used herein and in the appended claims, the singular forms "a", "and", and "the" include plural referents, unless the context clearly dictates otherwise. In the claims, the terms "first", "second", and so forth are to be interpreted merely as ordinal designations; they shall not be limited in themselves. Furthermore, the use of exclusive terminology such as "solely", "only", and the like in connection with the recitation of any claim element is contemplated. It is also contemplated that any element indicated to be optional herein may be specifically excluded from a given claim by way of a "negative" limitation. Finally, it is contemplated that any optional feature of the inventive variation(s) described herein may be set forth and claimed independently or in combination with any one or more of the features described herein.

All references cited herein, including publications, patent applications, and patents, are hereby incorporated by reference to the same extent as if each reference were individually and specifically indicated to be incorporated by reference, and were set forth in its entirety herein.

The recitation of ranges of values herein is merely intended to serve as a shorthand method of referring individually to each separate value falling within the range, unless otherwise indicated herein, and each separate value is incorporated into the specification as if it were individually recited herein.

One hydraulic railway switch device for moving railroad switch points includes a trailable switching unit (explained in detail in conjunction with FIGS. 1 and 2), a throw unit, a hydraulic unit, a center stroke unit, a mechanical target, a plurality of spring units, a plurality of proximity sensors, a power unit, a top cylinder rod bracket, a center bracket, a cam follower bearing, a hand throw pump, a block clamp, a control shaft, a safety latch, at least two separated centering blocks, a sensor target, a front flange, bushing, a hand throw socket, and a hydraulic directional valve.

Figure 2:
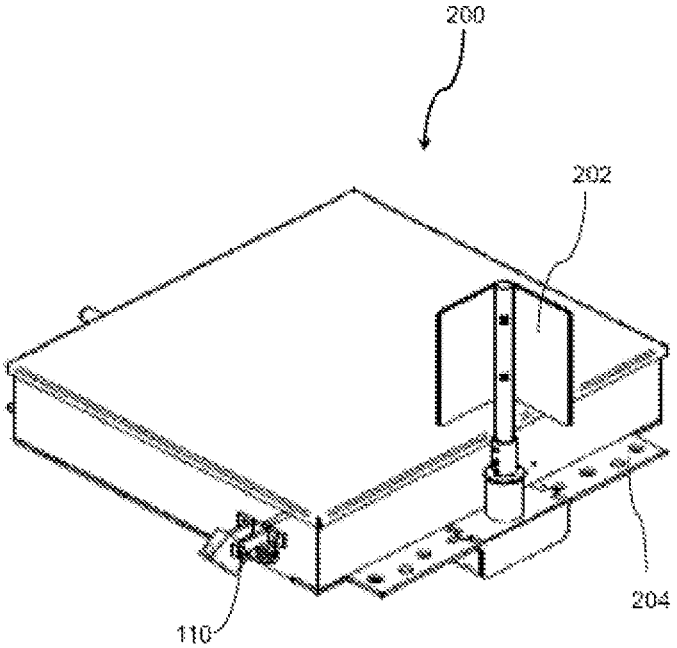
FIG. 2 illustrates a second general view of the trailable switching unit.
Figure 3:
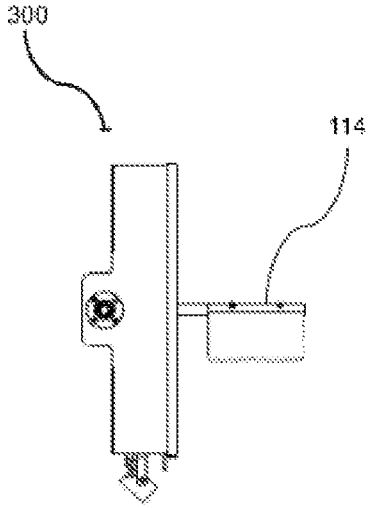
FIG. 3 illustrates a front view of the trailable switching unit.
Figure 4:
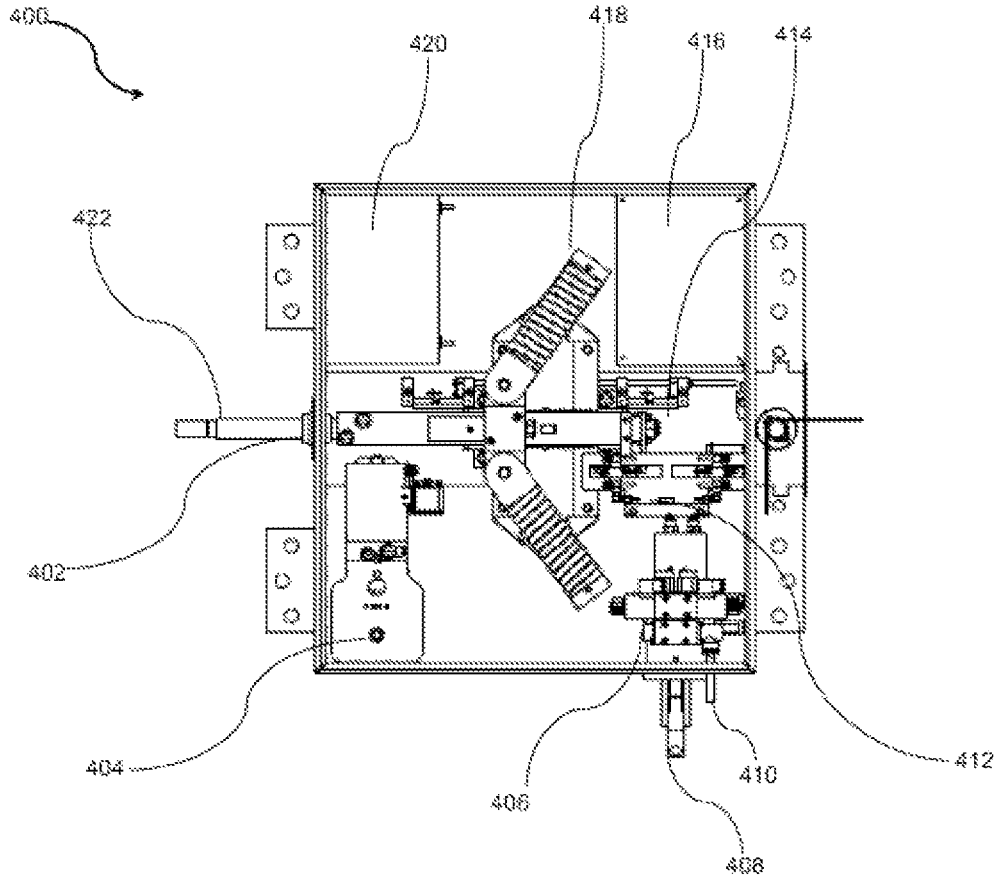
FIG. 4 illustrates a top view of the trailable switching unit without lids.
Figure 5:
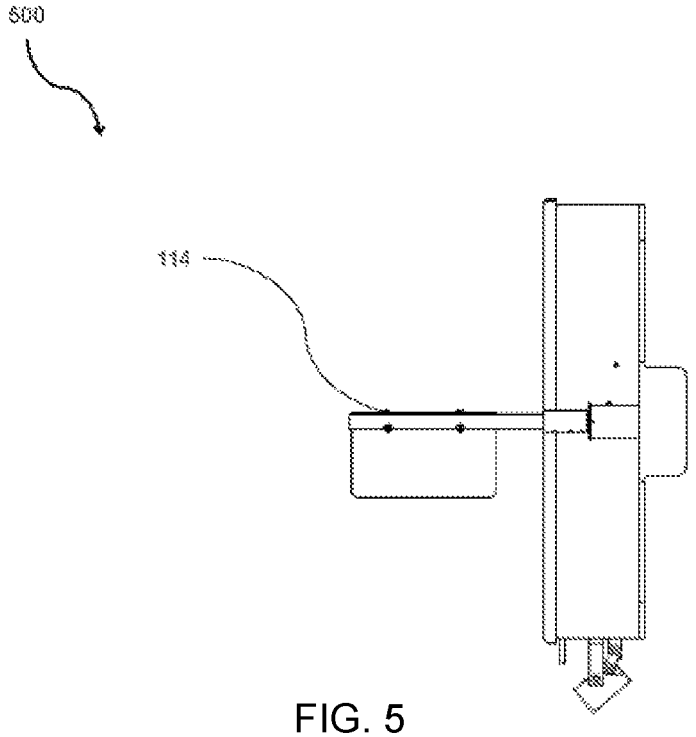
FIG. 5 illustrates a rear view of the trailable switching unit.

Simultaneous reference is made to FIGS. 1 through 3 in which FIG. 1 illustrates a first general view of a switch machine 100. Similarly, FIG. 2 illustrates a second general view of the switch machine 100 while FIG. 3 illustrates a front view of the switch machine 100 and FIG. 5 illustrates the rear view of the switch machine 100 (FIG. 4 is introduced and described in more detail below). The switch machine is said to be a 'trailable" switch unit in that a train may pass through the junction in a either a "facing" or a "trailing" (non-facing) direction.

The switch machine 100 includes a switch lid 102, a switch operation rod 104, front feet 106, a switch housing 108, a hand pump 110, hand operation direction lever 112, and a rear target 114 or mechanical target (mechanical rod position indication). The switch housing 108 is top-enclosed via the switch lid 102, and provides mounting structure for and environmental protection to the switch machine's 100 external components such as the switch operation rod 104, the front feet 106, the hand pump 110, the hand operation direction lever 112, and the rear target 114. The mechanical target 114 mechanically indicates the position of a point rod. In one embodiment, the hydraulic unit is directly connected to the point rod without intermediate components.

In FIG. 2 one can see that the switch machine 100 includes a rear foot 204, which provides further structural support for the rear target 114 and its corresponding target assembly.

In various embodiments, the switch machine 100 may be controlled through at least one of: a local PLC and/or a remote PLC. The PLC is used to control and monitor input signals from various input sensors, which report events and conditions occurring in a controlled process such as power on/off or emergency cut-off of the trailable switching unit. The voltages handled by the trailable switching unit tends to be relatively high. Furthermore, the voltages handled by the switch machine 100 may be direct current (DC) or alternating current (AC). However, the electronic components of the PLC typically operate at much lower DC voltages, such as 12 to 24 volts.

FIG. 4 illustrates a top view of the switch machine 100. From FIG. 4, one may see a front flange and bushing 402. The front flange and bushing 402 avoids the rod to bend under the stress caused by the train running through the trailable switching unit.

From FIG. 4 one may also see a power unit or hydraulic power unit 404, a hydraulic manifold 406, a hand pump and socket 408, a hand operation direction lever 410, the plurality of proximity sensors and bracket 412, a center stroke unit 414, an electric and electronic shelf 416, a spring unit 418, and a battery 420. A hydraulic unit includes a hydraulic manifold 406, a plurality of hydraulic cylinders 422, and a hydraulic circuit unit defined by the totality of items fluidly coupled. The hydraulic cylinder 422 provides constant forward movement and reverse movement to define an operation cycle (in time an operation cycle is called an "operation period"). The center stroke unit 414 blocks the hydraulic cylinder movement at middle stroke during installation and maintenance. The spring unit 418 produces a continuous thrust force to hold the railroad switch points closed when in forward position and reverse position.

In one embodiment, the plurality of proximity sensors detect the point rod's position. The power unit 404 supplies the hydraulic power to the hydraulic unit to move the hydraulic cylinder 422. In an alternative embodiment, the position of the point rod is detected by monitoring the spring holding force via, for example, by monitoring the pressure of the hydraulic fluid, and may use the detection of the pressure to verify or instead of data from the plurality of proximity sensors.

Figure 6:
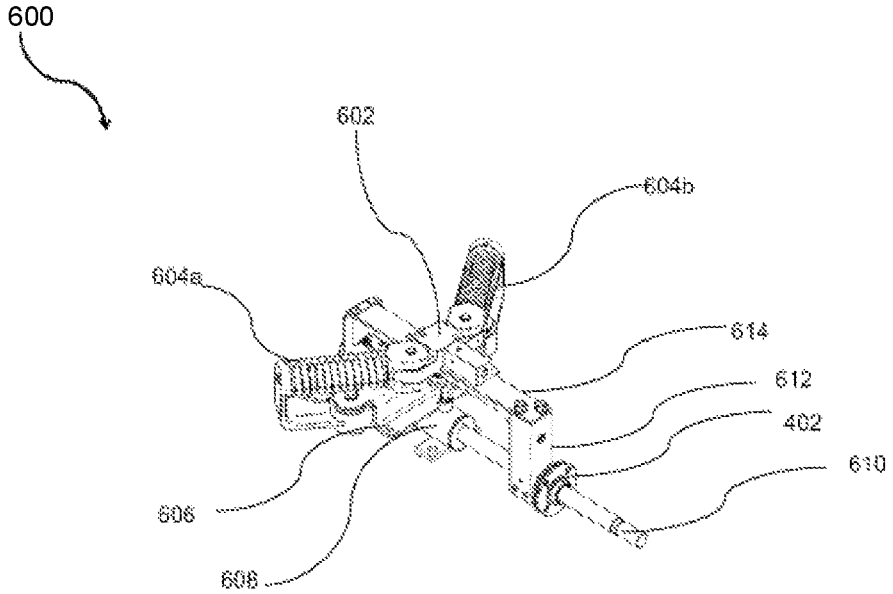
FIG. 6 illustrates components of a hydraulic cylinder and spring assembly.

FIG. 6 illustrates components of a hydraulic cylinder and spring assembly 600 (or also known as a 'switch operation rod assembly'). The hydraulic cylinder and spring assembly 600 includes a spring pivot bar 602, a plurality of springs 604*a* and 604*b*, a bearing guide bracket 606, a double rod hydraulic cylinder 608, a front cylinder rod 610, the flange and bushing 402, a front rod accoupling bar 612, a top cylinder bracket 614, a cam follower bearing (shown and explained in conjunction with FIG. 10), and a center bracket 606. The cam follower bearing installed under the top cylinder bracket 614 runs inside a center bracket roller tray to avoid rod rotation caused by external forces.

Figure 7:
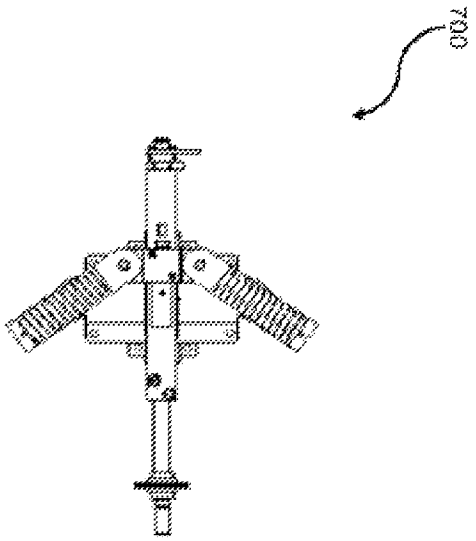
FIG. 7 illustrates a spring unit in a reverse position.
Figure 8:
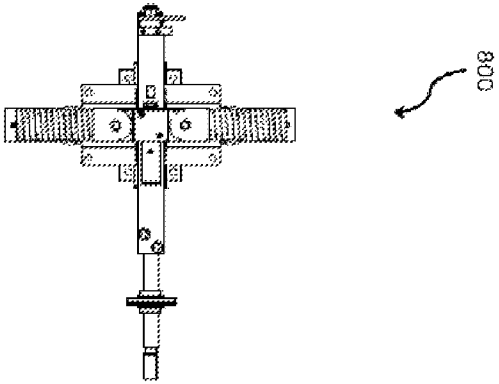
FIG. 8 illustrates the spring unit in a center position.
Figure 9:
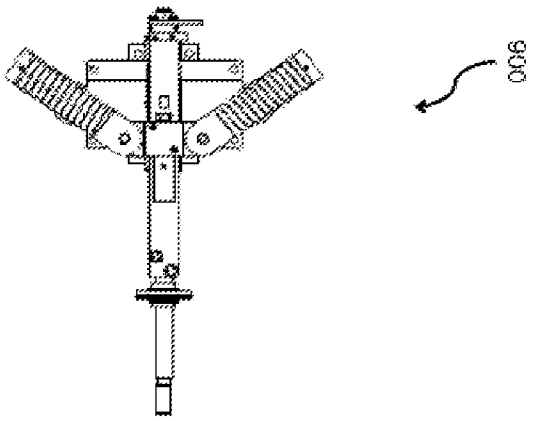
FIG. 9 illustrates the spring unit in a forward position.

FIG. 7 illustrates a spring unit in a reverse position 700. The hydraulic cylinder 422 or switch rod is positioned in a "reverse" position where the springs are pulling the railroad switch points. Similarly, FIG. 8 illustrates the spring unit in a center position 800. Following the motion of assembly from FIG. 7 to FIG. 8, when the hydraulic cylinder 422 starts moving, the two springs are compressed until a center stroke position is reached, at which point the springs decompress for the rest of remaining movement until a "forward" (fully expanded) position 900 is reached as illustrated in FIG. 9. In the forward position, the springs of the spring unit are pushing the railroad switch points.

At the center stroke position, the springs are fully compressed and are unstable, packed with potential energy. Any small movement or vibration while in the center stroke position would cause the springs to move (practically "jump") forward (forward position 900) or back (reverse position 700).

Preferably, the normal point throw distance is lower than the cylinder stroke so that the springs can apply a desired holding force to the points. Accordingly, the spring unit 418 (FIG. 4) holds the force applied to the railroad switch points to prevent the railroad switch points from moving out of correspondence and thus to avoid a train derailment.

Then, after the hydraulic cylinder 422 moves the points from one position to another, the hydraulic power is turned off and the rail points are kept closed by the spring force. If a train runs through the switch, the hydraulic cylinder 422 can completely move to the other position without damaging the switch machine's components; this means that there is no hydraulic restriction to the movement of the switch points.

Figure 10:
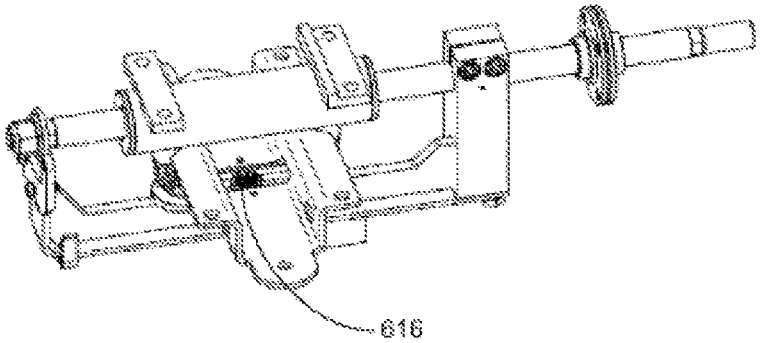
FIG. 10 illustrates a cam follower bearing.

FIG. 10 illustrates the cam follower bearing 616. The cam follower bearing 616 is secured under the top cylinder bracket, and runs inside the center bracket roller tray to avoid any rod rotation that may be caused by external forces. This facilitates the use of electronic proximity sensors, if desired.

Figure 11:
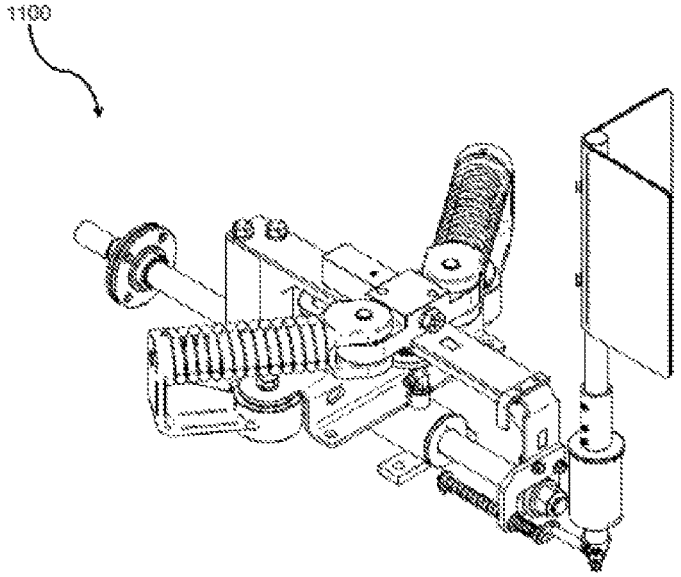
FIG. 11 illustrates a mechanical target in operation.
Figure 12:
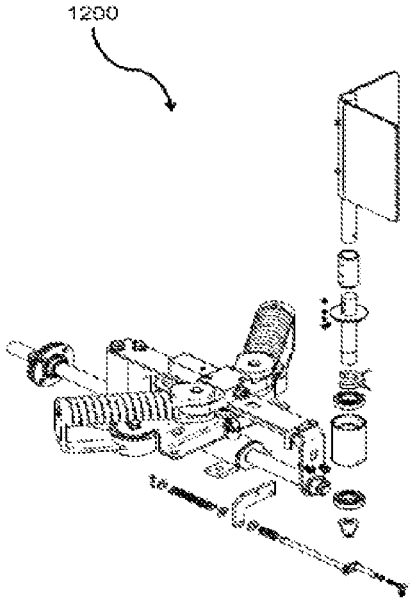
FIG. 12 illustrates components of the mechanical target.

For reference, FIG. 11 illustrates a mechanical target in operation, while FIG. 12 illustrates the components of the mechanical target in an exploded view. Because the mechanical target is coupled to the switch rod, the mechanical target automatically indicates the position of a point rod. In an alternative embodiment, the hydraulic unit is directly connected to the point rod without intermediate components.

Figure 13:
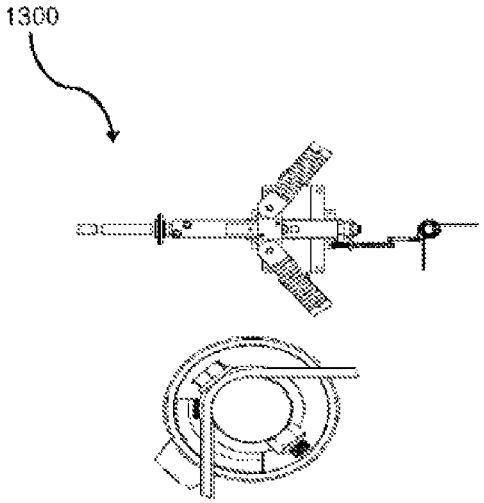
FIG. 13 illustrates a target and a rotation limit ring at a forward position.
Figure 14:
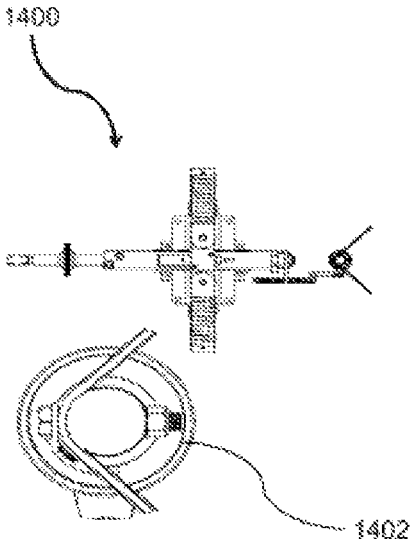
FIG. 14 illustrates the target and the rotation limit ring at a center position.
Figure 15:
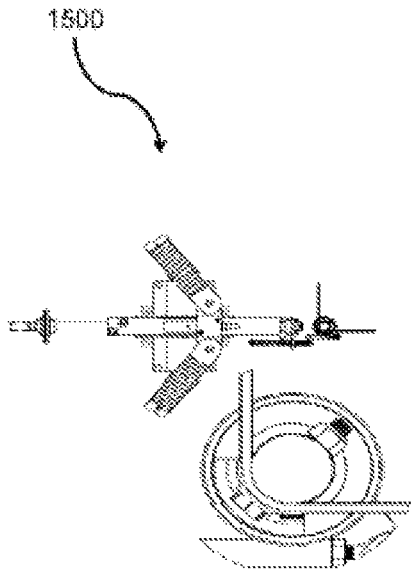
FIG. 15 illustrate the target and the rotation limit ring at a reverse position.

FIGS. 13-15 illustrate alternative positions of a rotation limit ring 1402. Here, the rotation limit ring 1402 is installed inside the target bearing housing to control the target position. A bolt may be used to limit the target rotation.

Figure 16:
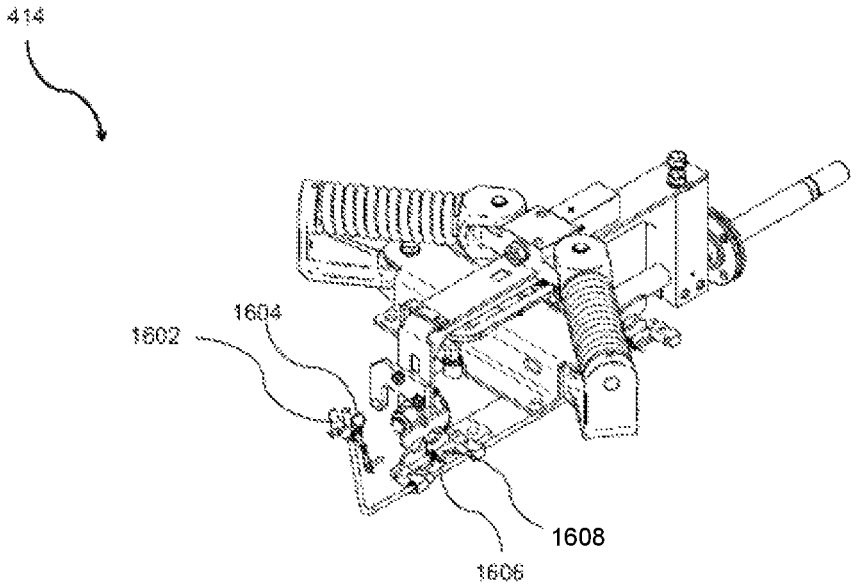
FIG. 16 illustrates a center stroke unit.
Figure 17:
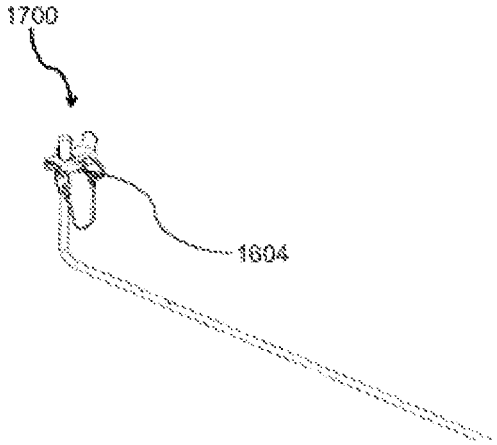
FIGS. 17 to 21 illustrate a control shaft in operation.
Figure 18:
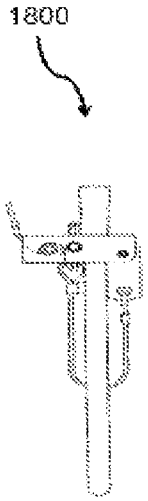
Figure 19:
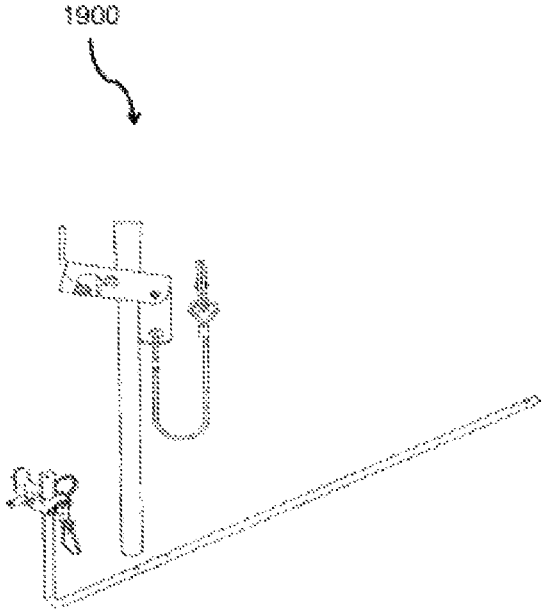

FIG. 16 illustrates the center stroke unit 414. The center stroke unit 414 includes a control shaft 1602, having a plurality of modes, wherein the plurality of modes include a disengaged and locked position mode. A safety latch 1604 locks the control or operation shaft at a disengaged and locked position mode; and at least two separated centering blocks 1606, 1608 are used to limit the cylinder piston movement in each direction until it is centered. In addition, the centering block operates regardless of the position of the switch.

FIGS. 17 to 21 illustrate the control shaft in operation. The secure/safety latch is designed to maintain the control shaft at the desired position. To unlock the control shaft, it is necessary to remove a lock pin with lanyard from a lock tab. The lock tab is released from the lock pin installed at the rear panel of the switch housing and the control shaft is rotated to the rest position (limit pin).

Figure 20:
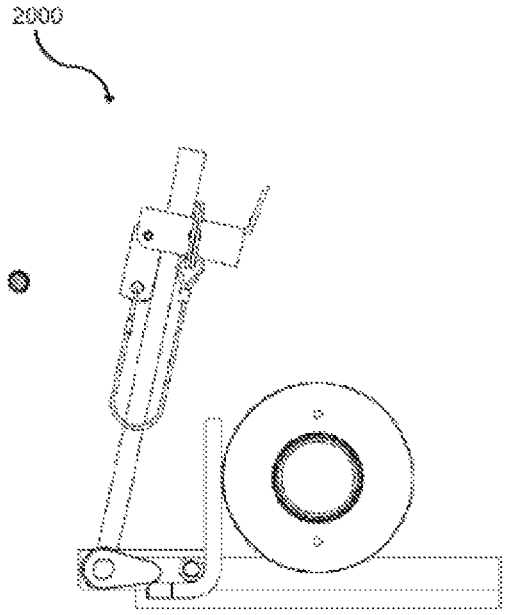
Figure 21:
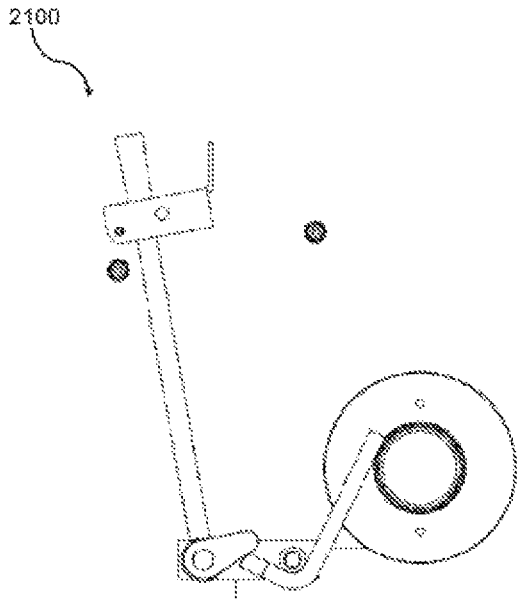
Figure 22:
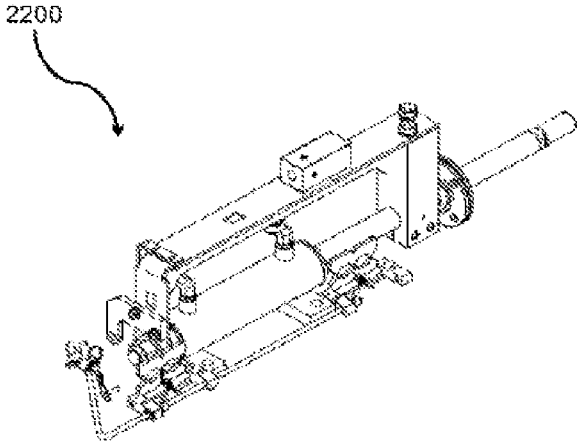
FIG. 22 illustrates the center stroke unit in locked position.
Figure 23:
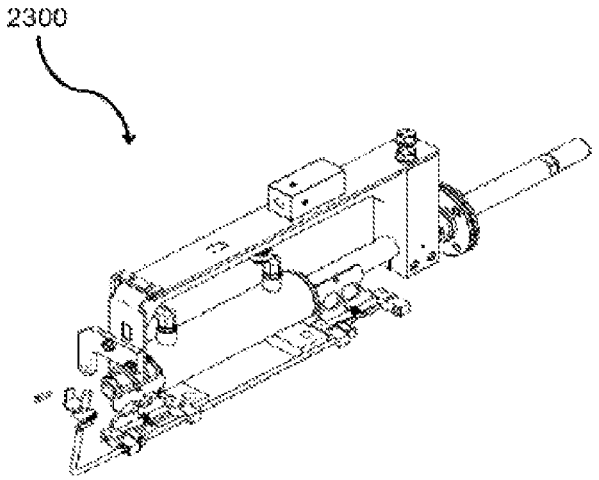
FIG. 23 illustrates the center stroke unit in unlocked position and one centring block in active position.
Figure 24:
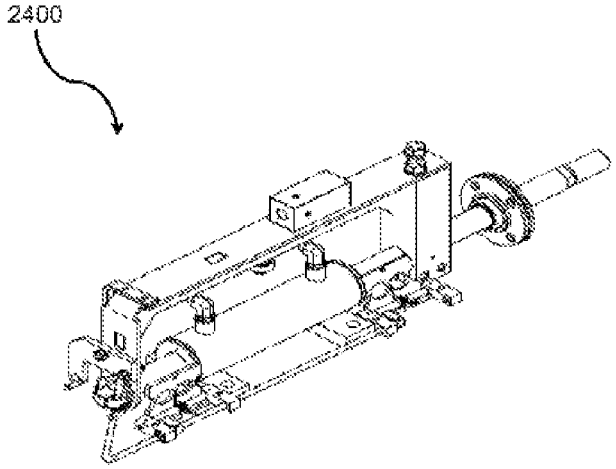
FIG. 24 illustrates the center stroke unit in unlocked position and the centring blocks, one in active position and other in the inactive position.
Figure 25:
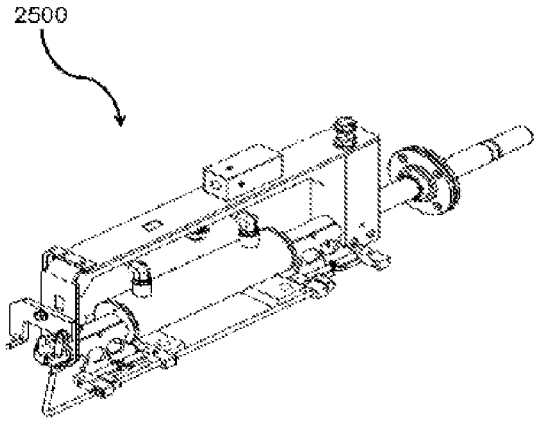
FIG. 25 illustrates the center stroke unit in unlocked position and both centring blocks at active position at middle switch stroke.

FIGS. 20 and 21 illustrate the control shaft in locked 2000 and unlocked 2100 positions. When the control shaft is unlocked, the two cams installed at the shaft will release the centering blocks. Each centering block has a torsion spring to move each one against the cylinder block to stop the cylinder movement at a middle stroke distance.

FIGS. 22-25 illustrate the center stroke unit (with springs and control rod omitted) 2200 in locked and unlocked positions. When the centering operation shaft is locked (FIG. 22), the two center blocks are kept upright, allowing the cylinder to move freely from reverse to forward position and vice versa. When the shaft is unlocked (FIG. 23) and moved to the rest position (with the limit pin removed), both center blocks are released to move and block the cylinder rod movement.

In an operation, one center block is pivoted completely toward the cylinder rod and the other is blocked by the top cylinder bracket or front rod bar. If a user operates the switch manually (hand throw operation), the cylinder rod will stop at the middle stroke blocked by a first center block. When the cylinder reaches the middle stroke, a second center block will also be pivoted, locking the cylinder movement in any direction. The centering blocks limit the movement of cylinder rod movement to half stroke or middle stroke.

The switch rod may remain at the middle stroke until the center blocks are returned to the upright position, the center operation (control) shaft is locked, and the lock pin is in place. The lock pin is a redundant safety measure to ensure that the center shaft is not released under a strong vibration situation.

Figure 26:
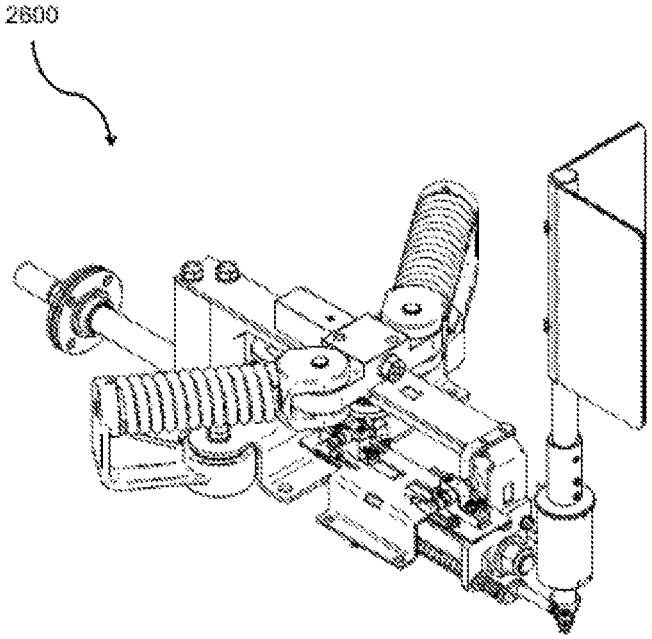
FIG. 26 illustrates the sensor unit location.
Figure 27:
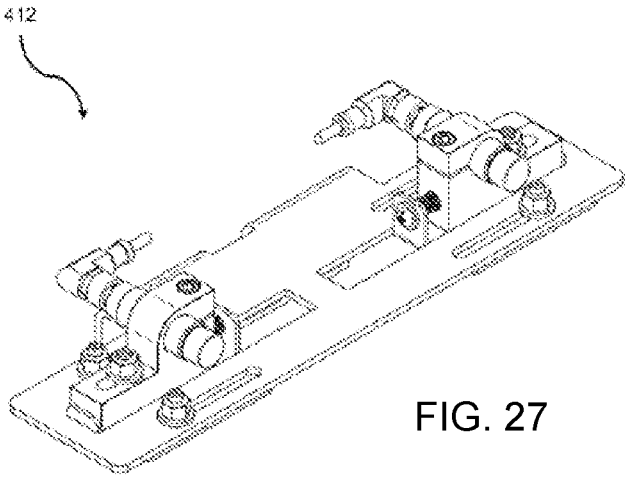
FIG. 27 illustrates the sensor unit assembly.

Simultaneous reference is now made to FIG. 26 and FIG. 27, which illustrate switch point detection through the plurality of proximity sensors mounted to the bracket or a mounting bracket (combinedly represented with reference numeral 412). The plurality of proximity sensors, preferably two, are installed in parallel to the switch operation rod. A sensor target installed at the top cylinder rod (see the description of the spring assembly set) bracket activates each proximity sensor at the desired reverse and forward positions.

Block clamps hold the plurality of proximity sensors in position. During installation, each sensor bracket is released to move the sensor block to the sensor activation position. The switch point opening should be adjusted to allow a small opening without a false opening alarm. The desired limit positions can be reached using a fine adjustment bolt associated with each proximity sensor as readily understood by those of skill in the art upon reading this disclosure.

Attention is now turned to an inventive embodiment switch machine 2800 that not only utilizes the aforementioned direct holding force (and is thus able to detect when the holding force is lost), but also provides two separate holding forces on two separate rods. One advantage of this configuration is that switch position can be reliably determined via detected known spring holding forces. Accordingly, in preferred embodiments the plurality of proximity sensors are utilized for verifying the switch position, while in other embodiments the plurality of proximity sensors are omitted without jeopardizing the safety of the overall system.

Figure 28:
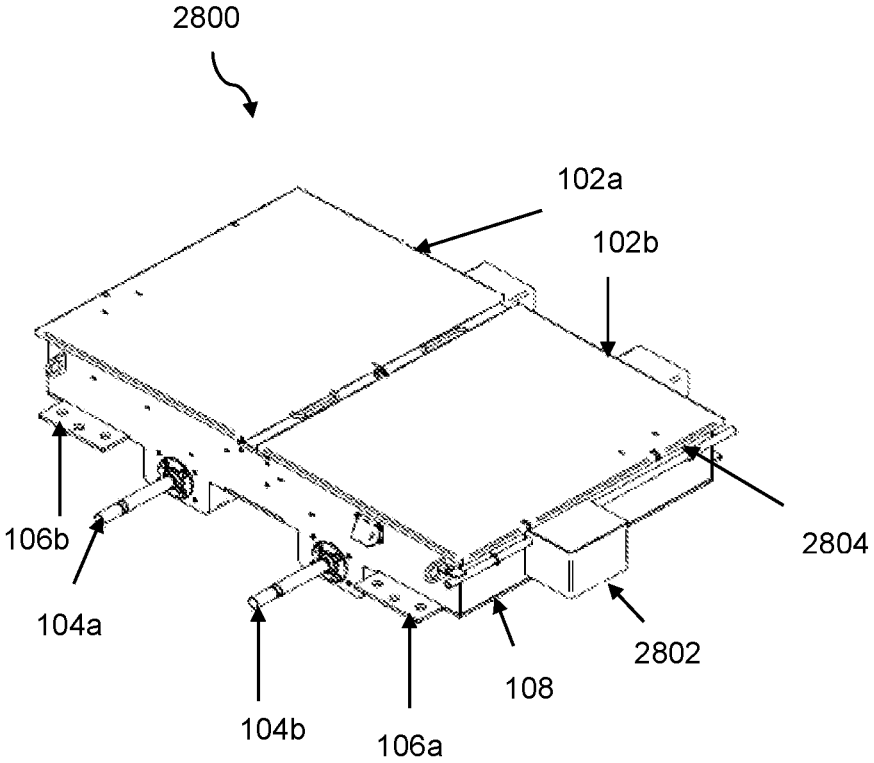
FIG. 28 illustrates a top front view of the trailable switching unit.

FIG. 28 illustrates a top front view of an inventive switch machine (trailable switching unit) 2800. The inventive switch machine 2800 includes a first switch lid 102*a* and a second switch lid 102*b*, a first switch operation rod 104*a*, a second switch operation rod 104*b*, a first front foot 106*a*, a second front foot 106*b*, and a switch housing 108. The switch housing 108 can be said to include the switch lids 102*a* and 102*b* that together define a top surface. The switch housing 108 also laterally supports the switch operation rods 104*a* and 104*b*, the front feet 106*a* and 106*b*, as well as a hand pump cover 2802, and a hand pump handle 2804.

Figure 29:
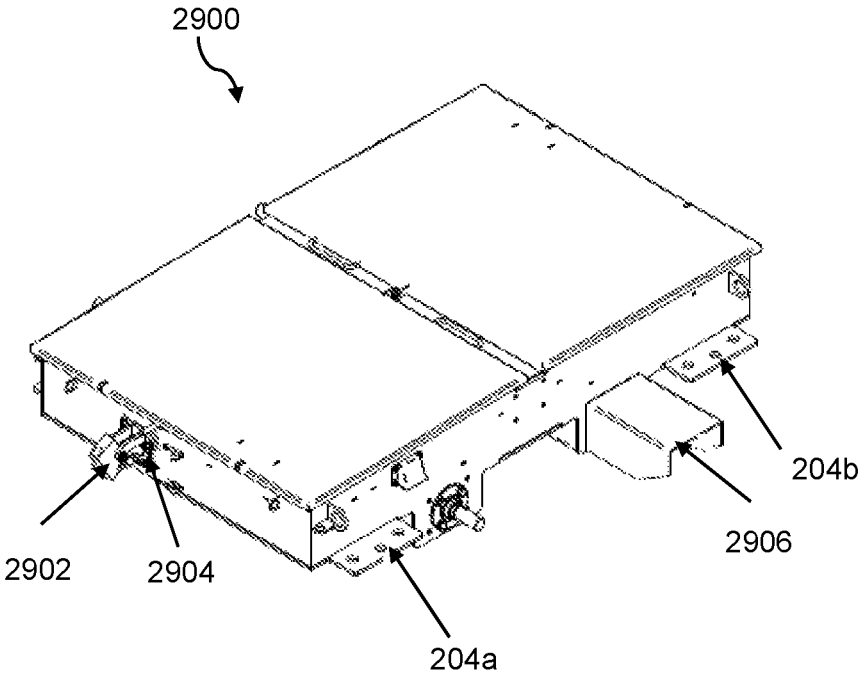
FIG. 29 illustrates a top rear view of the trailable switching unit.

FIG. 29 illustrates a top rear view of the switch machine 2800. As shown in FIG. 29, the switch machine 2800 includes a first rear foot 204*a* and a second rear foot 204*b*, a hand pump socket 2902, a hand pump operation directional lever 2904, and an operation rod cover 2906 (note that an operation rod cover for the second operation rod 104*a* is omitted for contextual clarity). The hand pump socket 2902 is connected with a hand pump piston (discussed below).

Figure 30A:
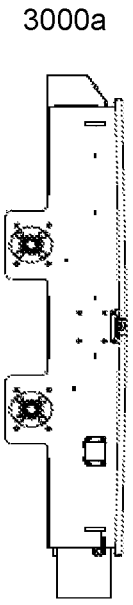
FIGS. 30*a*-30*b* illustrate different views of the trailable switching unit.
Figure 30B:
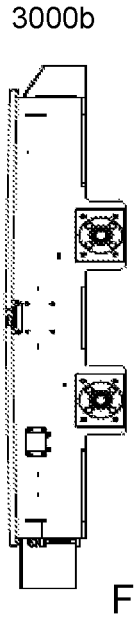

FIGS. 30*a*-30*b* illustrate different views of the inventive switch machine.

Figure 31:
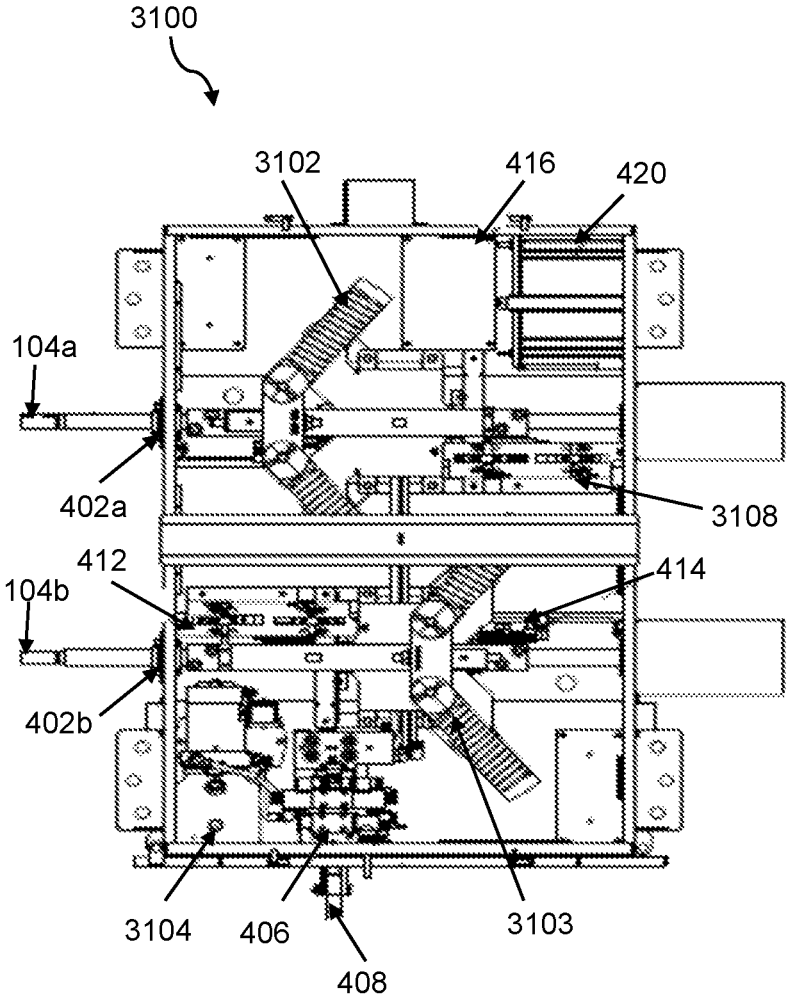
FIG. 31 illustrates a top view of the trailable switching unit without lid, i.e., interior of the trailable switching unit.

FIG. 31 illustrates a top view of the interior of the inventive switch machine 2800. Shown is a first front flange and bushing 402*a* and a second front flange and bushing 402*b*, the hand pump and socket 408, a first proximity sensor assembly and bracket 412 and a second proximity sensor assembly and bracket 3108, an electric and electronic tray and shelf 416, a battery 420 (preferably a 12V DC battery), an auxiliary electronic tray, a first spring assembly set 3102 and a second spring assembly set 3103, and a hydraulic power unit and manifold 3104.

In another embodiment, the power unit can be an AC power source, or combination of the AC power source with the DC type battery. The front flange and bushings 402*a*, 402*b* prevent the operation rods from bending under stresses.

Figure 32:
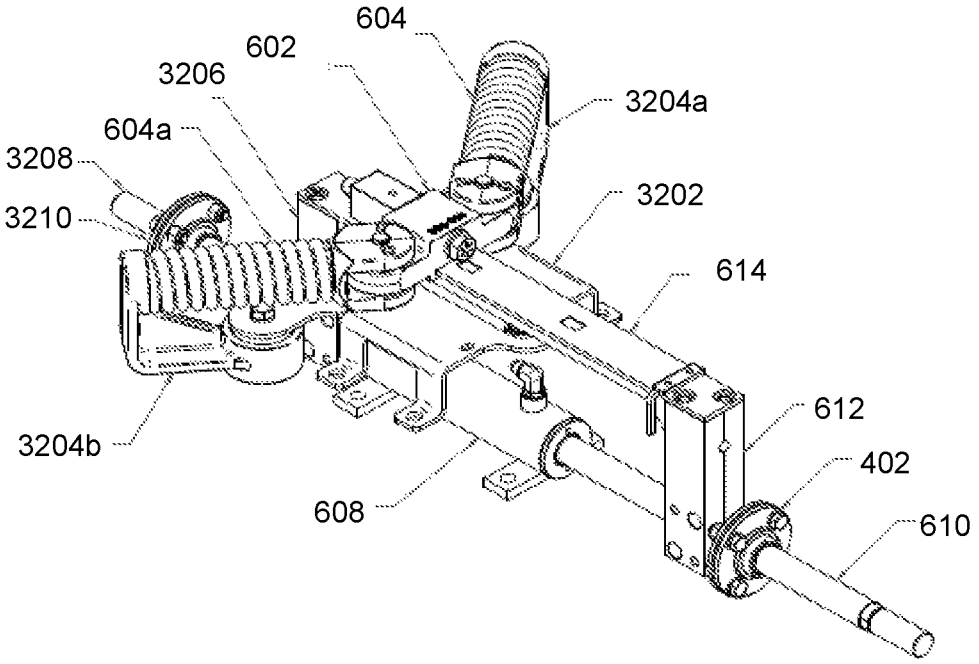
FIG. 32 illustrates an isometric view of a first holding force assembly.
Figure 33:
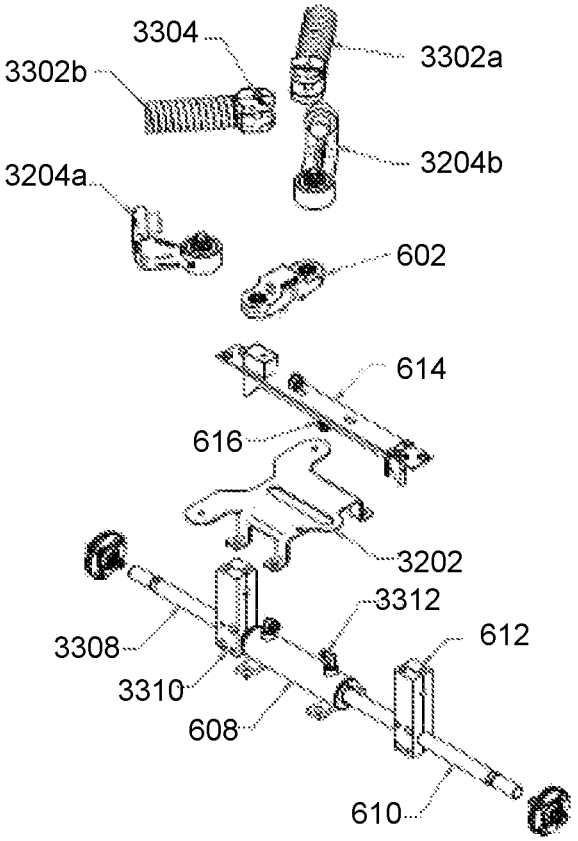
FIG. 33 is exploded isometric view of the first holding force assembly.
Figure 33A:
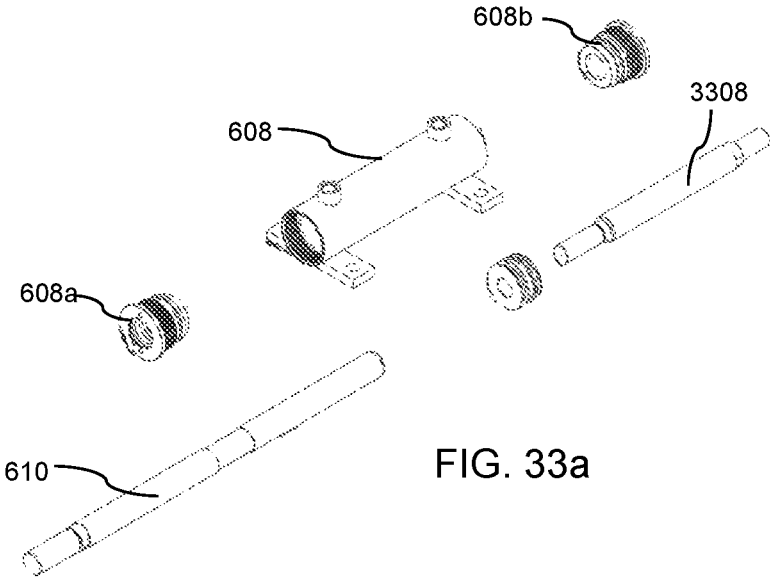
FIG. 33*a* is an exploded view of a double rod cylinder (hydraulic cylinder)

Simultaneous reference is now made to FIG. 32 which is an isometric view of a combination of a first hydraulic cylinder/connecting bar assembly, a first centering device and a first spring holding force assembly, as well as to (collectively "the first holding force assembly", FIG. 33 which is an exploded isometric view of the first holding force assembly and FIG. 33*a* which is an exploded view of a double rod cylinder (hydraulic cylinder) assembly.

A double rod cylinder assembly is comprised of a double rod cylinder 608, a front rod 610, and a rear rod 3308. Further, the double rod cylinder 608 has a first sealing cap 608*a* and a second sealing cap 608*b* (shown in FIG. 33*a*). A front rod bar 612 and a rear rod bar 3310 are secured to the double rod assembly comprising front rod 610 and rear rod 3308. A cylinder top bracket 614 centers the first holding force assembly and provides a backbone for coupling other parts of the holding force assembly. From one point of view, the rear rod bar 3310, the cylinder top bracket 614, and the front rod bar 612 function as a clamp coupling the front rod 610 to the rear rod 3308.

Now referring again to FIG. 32 and turning to the spring holding force assembly, which includes the spring pivot bracket 602, a first spring 604 mounted in a first spring pivot bar 3204*a*, and a second spring 604*a* mounted in a second spring pivot bar 3204*b*. The first and second spring pivot bars 3204*a*, 3204*b* couple to a bearing tray bracket 3202 which is attached to a base plate of the switch housing 108.

The front flange and bushing 402*a* provide an aperture for the front rod 610 while the rear flange and bushing 3210 provide an aperture for the cylinder rear rod 3308.

As shown in the FIG. 33, a cam follower bearing 616 is under the top cylinder rod bracket (cylinder top bracket or top cylinder bracket) 614 and runs inside the bearing tray bracket 3202 to avoid rod rotation caused by external forces. This also allows the use of electronic proximity sensors to detect the rod position to achieve high precision.

Further, the front rod 610 and rear rod 3308 are connected inside the hydraulic cylinder 608. The hydraulic pump (not shown here) is connected to the hydraulic cylinder 608 via a first hydraulic fitting 3312, and a second hydraulic fitting. Further, the rear rod bar 3310 is attached to the rear rod 3308 and the front rod bar 612 is attached with the front cylinder rod 610. The spring and clevis 3302*a* is supported with a spring pivot arm 3204*b*. Further, a sensor target is mounted at the top cylinder bracket 614 and activates each proximity sensor at the desired reverse position and forward position.

In an embodiment, the spring assembly sets 3102, 3103 are coupled to the switch operation rods 104*a* and 104*b* respectively. The spring assembly sets help move the railroad switch points when decompressing and keep the railroad switch points against a stock rail. The top cylinder brackets have a switch point position target 3802 (shown in the FIG. 38) connected to the switch operation rods by the rod bars 612, 3310. The switch point position target follows a movement of the cylinder rods. Further, the spring assembly set 3102 provides a spring holding force to the switch operation rods 104*a*. The spring holding force provides a safe operation of the switch point position assembly 3108 by at least one of determining that the spring holding force is present in the moving railroad switch point, and pushing the spring holding force towards the switch point position assembly 3108 away from the at least one sensor.

In an example, in the railroad switch device, a first 50% of the throw of the switch points must overcome the spring holding force being applied to the points sitting at rest against the stock rail. Once the throw of the switch points has passed 50% of its movement, the spring force will assist the closure of the switch points to the stock rail. Spring decompression forces of 2400 lbs are applied to the switch points to hold them to the stock rail.

In an embodiment, the switch point position assembly 402*b* (FIG. 34) is integrated with the operation rod 104*a*. The spring assemblies 3103 provide the holding force to the operation rod 104*b*. The spring holding force also provides a secondary but important addition to the safe operation of the switch machine. If either operation rod is disconnected from the switch point bar, the spring decompression force will cause the point detection system to immediately indicate the switch is out of correspondence (as shown in the FIG. 37).

In an example, the railroad switch device operates on 12 VDC and has a battery integrated into the switch housing. Instead of 1.2 seconds to move the switch points as it does in the device of the referenced related application, it takes 2.6 seconds or less for the present invention. The railroad switch device operates for 100 throws on the 12 VDC battery in the machine without charging.

Further, the railroad switch device includes a backup manual pump hand throw assembly in case of power failure. When the hand pump cover 2802 is opened, the switch machine operation is disabled and an indication it is opened is provided to the electric system. It can be installed at the left or right side of the rail with minimal changes to make to the railroad replace others switch device.

Figure 34:
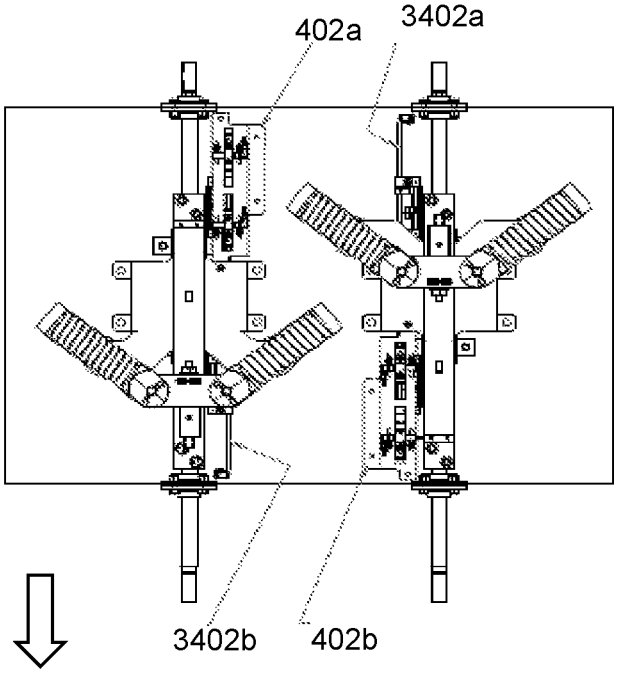
FIG. 34 and FIG. 35 are top perspective views of the switch operation rods extended on one side of the switch.
Figure 35:
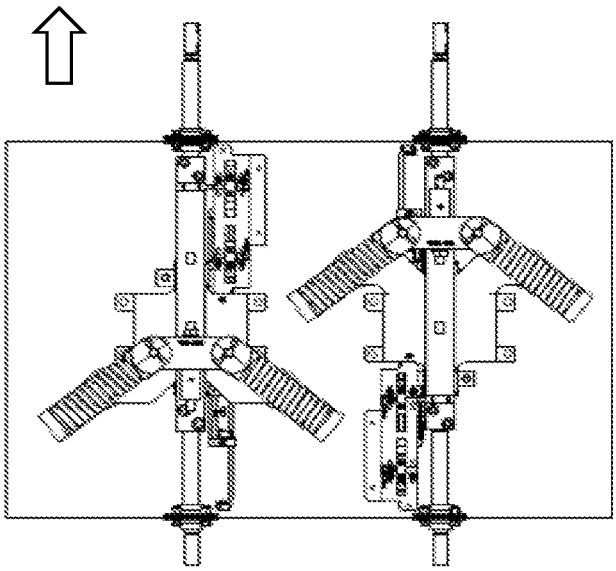

FIG. 34 is a top perspective view of the switch operation rods 104*a* and 104*b* extended on one side of the switch. FIG. 35 is a top perspective view of the switch operation rods extended on another side of the switch.

Figure 36:
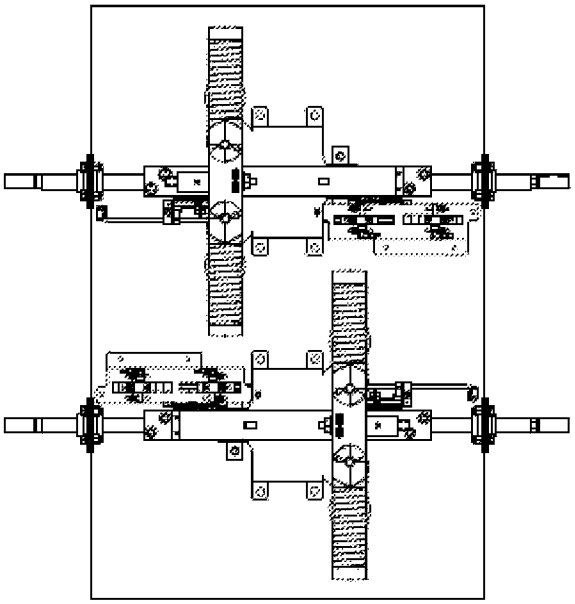
FIG. 36 is a top perspective view of the switch in which the operation rods and springs assembly sets are in a center position.
Figure 37:
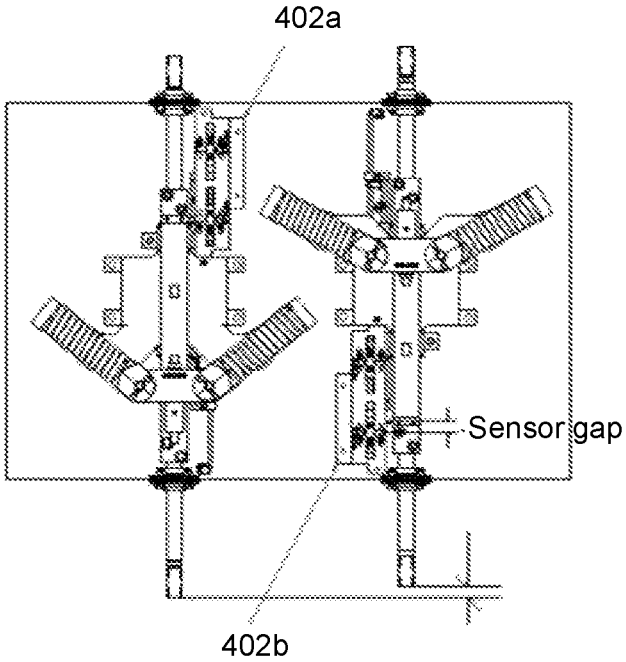
FIG. 37 is a top perspective view of the switch operation rods on the switch.

FIG. 36 is a top perspective view of the switch in which the spring assembly set is in a center position, while FIG. 37 is a top perspective view of the switch operation rods 104*a* and 104*b* on the switch. As shown in the FIG. 37, if the operation rod is disconnected from the rail points, the spring acting force will allow one rod to move more than the other. The difference will be detected by the position sensors.

Figure 38:
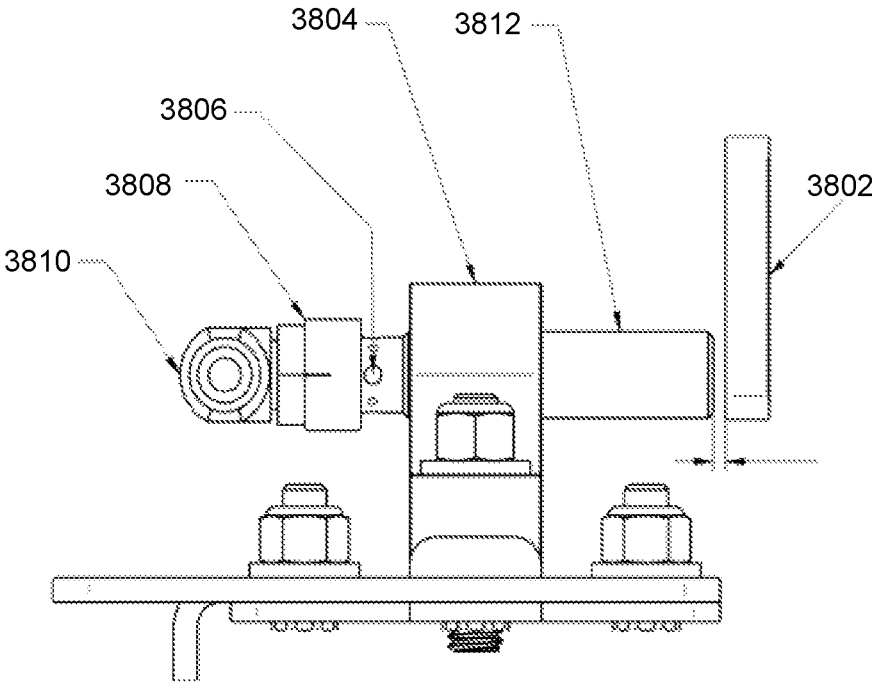
FIG. 38 is a side view of the proximity sensors and bracket.
Figure 39:
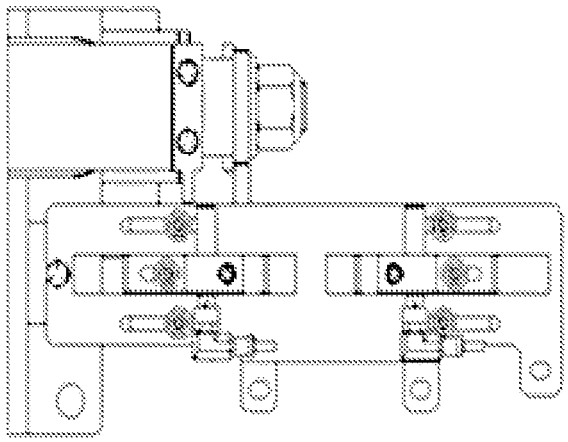
FIG. 39 is a schematic view in which the sensor target is out of proximity sensor detection zone.

FIG. 38 is a side view of the proximity sensors and mounting bracket 412 (from FIG. 27) and the sensor target 3802 that is mounted to the cylinder top bracket 614. FIG. 39 is a schematic view in which the sensor target is out of proximity sensor detection zone.

Operational Advantages

Unlike conventional devices, the inventive switch machine ensures that if any of the switch operation rod is disconnected from the rail points, the spring force of the assembly will push the switch point position target 3802 away from the proximity sensors (as shown in FIGS. 37 and 38). As an example, the throwing stroke of the railroad switch device is 6.5 inches to provide a full 0.875 inches of over stroke capability on both the normal and reverse point position when the point throw distance is 4.75 inches.

The railroad switch device utilizes two PNP (positive-negative-positive) high quality, focused beam proximity sensors on one rod and two NPN (negative-positive-negative) high quality, focused beam proximity sensors on the other rod assembly as is readily understood by those of skill in the art upon reading this disclosure. The switch point position target is specifically sized to provide fine adjustments for detection of the switch points opening to meet mainline requirements.

When in standard operation one rod provides +12 DC position indications and the other rod provides −12 DC position indications. The indications are monitored by the control system logic (either by the switch control processor or the vital controller for the signal system or both) to ensure that no proximity sensor has failed. If an input from the proximity sensor is shorted, the logic of the control software will detect this and cause the system to show that an out of correspondence condition has occurred.

Further, the railroad switch device is preferably 8.5 inches high; and as shown its throw rods are directly in-line with the switch layout rods. This eliminates the need to dap the ties for installation of the switch assembly or the need to have offset rods made to connect the switch machine to the switch layout.

The 12 VDC operation of the switch machine eliminates the need for a separate set of expensive batteries in the signal bungalow for 24 VDC back up required for the traditional switch machines. All bearings are sealed, and so there are no grease fittings or lubrication oils needed. Additionally, the hydraulic system is a closed loop system which eliminates contaminants that could get into the drive fluid. The switch machine is preferably fully operational to temperatures of −40 C and plus 80 C.

Moreover, the 12 VDC operation for the switch machine reduces the size of the location battery backup and provides longer operation time on battery backup. Meanwhile, constant holding force of the switch point is achieved with redundant mechanical springs on the throw rod providing 3000 lbs of holding force.

An additional advantage is that the inventive switch machine provides faster throw time (2.6 seconds). This throw force is double than that of traditional switch machines (handles longer turnouts). Further, the inventive switch machine achieves soft point closure with motor shut off sequence starting with ¼ inch prior to point closure. Mechanical springs finish the last ¼ inch of each stroke.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms enclosed. On the contrary, the intention is to cover all modifications, alternative constructions, and equivalents falling within the spirit and scope of the invention, as defined in the appended claims. Thus, it is intended that the present invention cover the modifications and variations of this invention, provided they are within the scope of the appended claims and their equivalents.

What is claimed is:

1. A railroad switch device for moving railroad switch points, the railroad switch device comprising:

a first switch operation rod assembly and a second switch operation rod assembly;

the first switch operation rod assembly comprising a first spring assembly coupled to a first switch operation rod;

the first switch operation rod being set into a first hydraulic cylinder;

the second switch operation rod assembly comprising a second spring assembly coupled to a second switch operation rod;

the second switch operation rod being set into a second hydraulic cylinder;

the first switch operation rod assembly being couplable to a first railroad switch point of a railroad track switch;

the second switch operation rod assembly being couplable to a second railroad switch point of the railroad track switch;

a hydraulic pump assembly comprising a hydraulic pump and a hydraulic reservoir for maintaining a hydraulic fluid;

the hydraulic reservoir in fluid communication with the first hydraulic cylinder and the second hydraulic cylinder;

the first switch operation rod and the second switch operation rod have a first extended position, the first switch operation rod being held in place by a spring holding force generated via the first spring assembly, the second switch operation rod being held in place by a spring holding force generated via the second spring assembly;

the first switch operation rod and the second switch operation rod have a second retracted position, the first switch operation rod being held in place by a spring holding force generated via the first spring assembly, the second switch operation rod being held in place by a spring holding force generated via the second spring assembly; and movement between the first extended position and the second retracted position is achievable by altering a hydraulic fluid pressure in the first hydraulic cylinder and the second hydraulic cylinder.

2. The railroad switch device according to claim 1 wherein said switch operation rods are physically offset to accommodate the width of a railroad track switch.

3. The railroad switch device according to claim 1 wherein the switch operation rods articulate 4.75 inches.

4. The railroad switch device according to claim 1 wherein the railroad switch device comprises a power unit to supply electric power to the hydraulic pump.

5. The railroad switch device according to claim 1 further comprising a switch point position assembly that detects if a switch operation rod is disconnected, cut, or broke.

6. The railroad switch device according to claim 1 further comprising a hand pump coupled to the reservoir to manually articulate the railroad switch device.

7. The railroad switch device according to claim 1 where electric power is disabled from the hydraulic motor a hand pump access cover is opened.

8. The railroad switch device according to claim 1 wherein the first switch operation rod assembly further comprises a cam follower bearing under a top cylinder bracket that runs inside a centering bracket roller tray.

9. The railroad switch device according to claim 8 wherein a first switch point position target is arranged close to the first top cylinder rod bracket, the first switch point position target being adapted to activate the at least one sensor at a desired position.

10. The railroad switch device according to claim 1 further comprising a first proximity sensor assembly coupled proximate to the first switch operation rod.

11. The railroad switch device according to claim 1 wherein each switch operation rod assembly comprises:

a center stroke unit having a control shaft having plurality of modes, wherein the modes, including center stroke unit, are in a disengaged and locked position mode, and the center stroke unit is in an engaged position mode;

a safety latch, locking the operation shaft in the disengaged and locked position mode; and at least two separated centering blocks to limit the cylindrical movement in each direction.

12. The railroad switch device according to claim 1 further comprises a housing that maintains the first switch operation rod assembly and a second switch operation rod assembly, whereby a flange and bushing couples the first switch operation rod to the housing to secure the first rod from mechanical forces and stresses.

13. The railroad switch device according to claim 1 further comprising a control system coupled to the power source.

* * * * *